US008109023B2

(12) United States Patent
Pikielny

(10) Patent No.: US 8,109,023 B2
(45) Date of Patent: Feb. 7, 2012

(54) SHOT COUNTER

(76) Inventor: Dov Pikielny, Herzliya (IL)

( * ) Notice: Subject to any disclaimer, the term of this patent is extended or adjusted under 35 U.S.C. 154(b) by 171 days.

(21) Appl. No.: 12/705,997

(22) Filed: Feb. 16, 2010

(65) Prior Publication Data

US 2010/0139141 A1 Jun. 10, 2010

Related U.S. Application Data

(63) Continuation-in-part of application No. 11/559,956, filed on Nov. 15, 2006, now Pat. No. 7,661,217.

(51) Int. Cl.
*F41A 9/53* (2006.01)

(52) U.S. Cl. ..... 42/1.01; 42/1.02; 42/1.03; 42/1.04; 42/1.05

(58) Field of Classification Search ..... 42/1.01–1.05
See application file for complete search history.

(56) References Cited

U.S. PATENT DOCUMENTS

| | | | | | |
|---|---|---|---|---|---|
| 3,997,994 | A * | 12/1976 | Kastner et al. | 42/9 |
| 5,005,307 | A * | 4/1991 | Horne et al. | 42/1.02 |
| 5,052,138 | A * | 10/1991 | Crain | 42/1.02 |
| 5,206,444 | A * | 4/1993 | Oliver | 42/1.02 |
| 5,402,678 | A * | 4/1995 | Fritz et al. | 73/167 |
| 5,406,730 | A * | 4/1995 | Sayre | 42/1.02 |
| 5,566,486 | A * | 10/1996 | Brinkley | 42/1.02 |
| 5,642,581 | A * | 7/1997 | Herold et al. | 42/1.02 |
| 5,826,360 | A * | 10/1998 | Herold et al. | 42/1.02 |
| 5,926,987 | A * | 7/1999 | Novak | 42/1.05 |
| 6,094,850 | A * | 8/2000 | Villani | 42/1.02 |
| 6,161,322 | A * | 12/2000 | Liebenberg | 42/1.05 |
| 6,256,915 | B1 * | 7/2001 | da Silveira | 42/1.05 |
| 6,493,977 | B1 * | 12/2002 | Liebenberg et al. | 42/1.05 |
| 6,622,411 | B2 * | 9/2003 | Liebenberg et al. | 42/1.05 |
| 6,785,994 | B2 * | 9/2004 | Christiansen | 42/1.05 |
| 6,857,213 | B2 * | 2/2005 | Fluhr | 42/1.05 |
| 7,356,956 | B2 * | 4/2008 | Schinazi et al. | 42/1.01 |
| 7,661,217 | B2 * | 2/2010 | Pikielny | 42/1.01 |
| 2004/0200109 | A1 * | 10/2004 | Vasquez | 42/1.01 |
| 2006/0010744 | A1 * | 1/2006 | Schumacher | 42/1.01 |
| 2006/0042142 | A1 * | 3/2006 | Sinha | 42/1.01 |
| 2006/0096144 | A1 * | 5/2006 | Delgado Acarreta | 42/1.01 |
| 2008/0016744 | A1 * | 1/2008 | Joannes et al. | 42/1.01 |
| 2008/0110073 | A1 * | 5/2008 | Pikielny | 42/1.03 |
| 2010/0139142 | A1 * | 6/2010 | Pikielny | 42/1.05 |

* cited by examiner

*Primary Examiner* — Michael David
(74) *Attorney, Agent, or Firm* — Dekel Patent Ltd; David Klein

(57) ABSTRACT

A shot counter includes a firearm with a loaded chamber indicator and a striker status indicator. A first switch operates with the loaded chamber indicator and a second switch operates with the striker status indicator. When the loaded chamber indicator moves it activates the first switch and when the striker status indicator moves it activates the second switch. If one of the first and second switches is activated, an electrical signal is sent to a processor and the processor interprets the electrical signal as an indication that a shot has been fired. If the electrical signal is from the first switch, the processor actually counts a number of cartridges going in and out of a chamber of the firearm, and if the electrical signal is from the second switch, the processor actually counts a number of times the firearm was cocked.

5 Claims, 4 Drawing Sheets

SHOT COUNTER

CROSS-REFERENCE TO RELATED APPLICATIONS

This application is a continuation-in-part of, and claims priority under 35 USC §120 from, U.S. patent application Ser. No. 11/559,956, filed Nov. 15, 2006, now U.S. Pat. No. 7,661,217, which is incorporated herein by reference.

FIELD OF THE INVENTION

The present invention relates generally to a shot counter for a weapon, and particularly to a shot counter that links to an existing indicator mechanism of the weapon (e.g., round-in-the-chamber indicator) so that the existing indicator serves as a shot counter as well.

BACKGROUND OF THE INVENTION

There are many devices used to indicate if a round is in a chamber of a handgun. For example, U.S. Pat. Nos. 6,857,213, 6,785,994, 6,622,411, 6,493,977, 6,161,322, 6,256,915, 5,926,987, 5,826,360, 3,997,994 and 6,094,850 have various designs for round-in-the-chamber indicators, wherein a lever springs up (typically from the slide or upper portion of the handgun) when a round is in the chamber.

For example, The XD model handgun of Springfield Armory has two indicators—a striker status (cocked) indicator and a loaded chamber indicator. The loaded chamber indicator is a small button, just above the breech on top of the gun's slide, which pops up (by means of mechanical action) when a round is in the chamber. The button does not interfere with the shooter's line of sight, but is high enough to be seen easily, or felt by hand (e.g., for use in the dark). The striker status indicator works much the same way (can be a spring-loaded mechanical action), but is located on the rear face of the slide, so the shooter can instantly tell whether or not the gun is cocked. The striker status indicator pops rearward out of the rear face of the slide when the gun is cocked and is flush with the rear face of the slide when the gun is not cocked.

SUMMARY OF THE INVENTION

The present invention seeks to provide a shot counter that links to an existing indicator mechanism of the weapon (e.g., round-in-the-chamber indicator) so that the existing indicator serves as a shot counter as well, as is described in detail further hereinbelow.

There is thus provided in accordance with an embodiment of the present invention a method including sensing movement of an existing non-shot-indicator of a handgun, and interpreting a sensed movement of the existing non-shot-indicator as a shot fired from the handgun so that the sensed movement serves as a shot counter for the handgun.

The method can include one or more of the following features. For example, the existing non-shot-indicator of the handgun may include a round-in-the-chamber indicator, wherein the sensed movement of the round-in-the-chamber indicator is interpreted as a shot fired from the handgun. As another example, the existing non-shot-indicator of the handgun may include a striker status indicator, wherein the sensed movement of the striker status indicator is interpreted as a shot fired from the handgun. An accessory may be positioned to come into contact with an element of the non-shot-indicator, wherein sensing movement of the existing non-shot-indicator may include sensing the element of the non-shot-indicator moving into contact with the accessory. The element of the non-shot-indicator may move into mechanical contact with the accessory and cause a portion of the accessory to move and indicate a shot has been fired. The element of the non-shot-indicator may move into electrical contact with the accessory and close a circuit, wherein closure of the circuit indicates a shot has been fired.

Alternatively, sensing movement of the existing non-shot-indicator may be by means of an optical sensor, accelerometer, capacitance sensor or Hall effect sensor. Upon compression of the recoil spring, the Hall effect sensor senses a change in magnetic field that is a function of proximity of the coils to one another.

There is also provided in accordance with an embodiment of the present invention a method including sensing movement of a recoil spring of a handgun, and interpreting a sensed movement of the recoil spring as a shot fired from the handgun so that the sensed movement serves as a shot counter for the handgun.

For example, sensing movement of the recoil spring may include sensing compression of the recoil spring, wherein compression of the recoil spring indicates a shot has been fired. The compression of the recoil spring may be sensed by electrical contacts, wherein upon compression of the recoil spring, the electrical contacts come into contact with one another and close a circuit, wherein closure of the circuit indicates a shot has been fired. Alternatively, compression of the recoil spring may be sensed by an optical sensor, accelerometer, capacitance sensor or Hall effect sensor.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

In accordance with an embodiment of the present invention, an existing non-shot-counter indicator of a handgun is exploited and turned into an extra indicator, namely, a shot counter which indicates the number of shots fired by the weapon. Non-limiting examples of existing non-shot-counters are a striker status (cocked) indicator and a loaded chamber indicator, such as those found, for example, on the Springfield Armory XD models, or a firearm safety indicator device.

The present invention is distinguished in one respect from the prior art by using existing non-shot-counters or indicators as opposed to other moving parts of the handgun. For example, it is known in the prior art to use the movement of the slide to actuate a shot counter. However, the slide is of course not an indicator or a counter (the terms counter and indicator being used interchangeably); the present invention provides a different concept.

Figure 1:
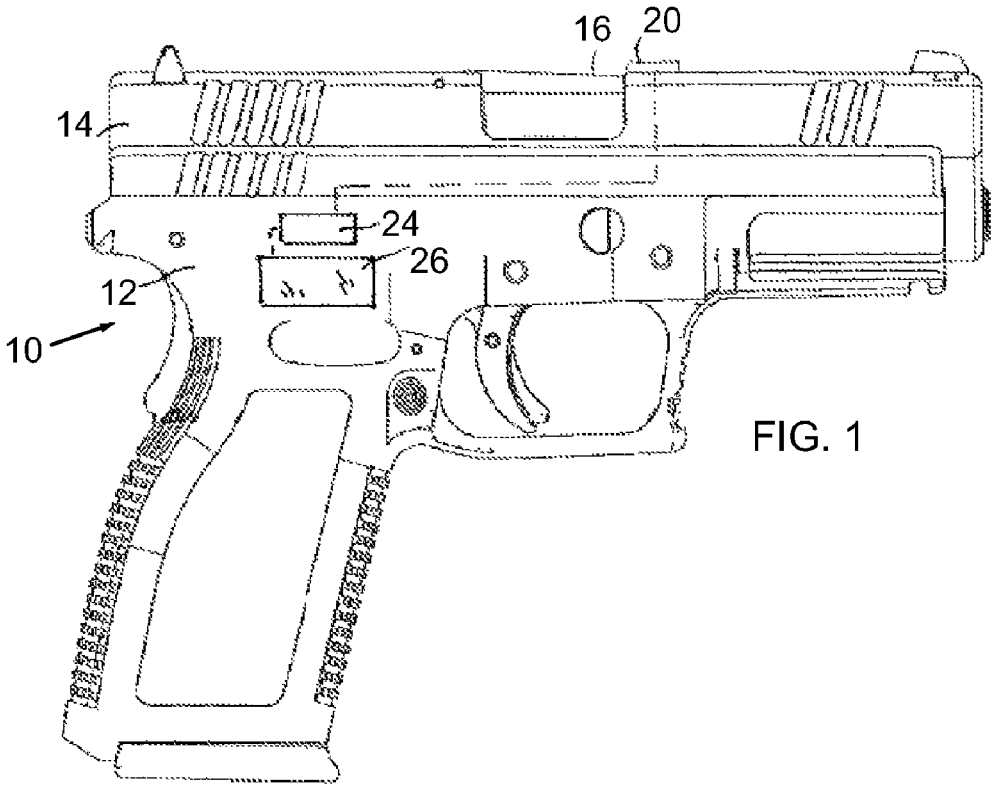
FIG. 1 is a simplified illustration of a shot counter for a handgun, constructed and operative in accordance with an embodiment of the present invention.
Figure 2A:
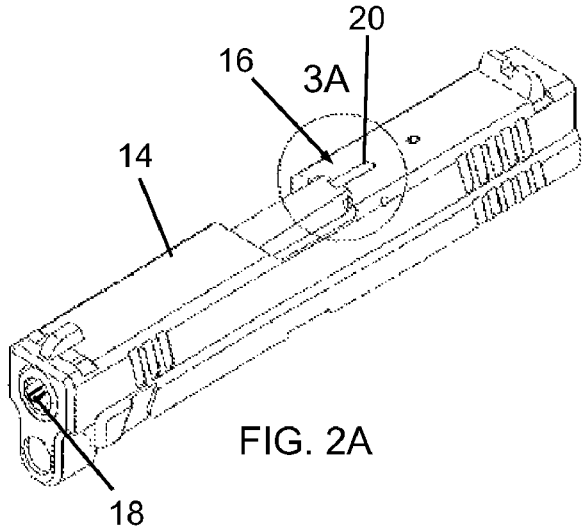
FIGS. 2A and 2B are simplified illustrations of the slide of the handgun of FIG. 1, with a loaded chamber indicator and a striker status indicator.
Figure 2B:
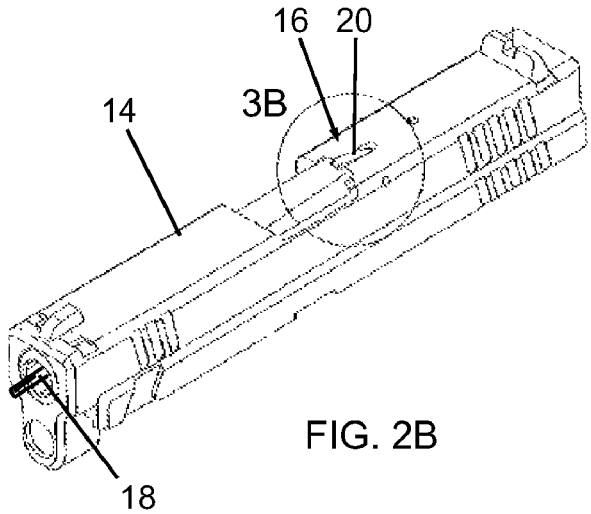

Reference is now made to FIG. 1, which illustrates a shot counter, constructed and operative in accordance with an embodiment of the present invention. FIG. 1 illustrates a handgun 10, e.g., one of the Springfield Armory XD models. Handgun 10 includes a receiver 12 and a slide 14. As seen additionally in FIGS. 2A and 2B, the slide 14 may include a loaded chamber indicator 16 and a striker status indicator 18. The loaded chamber indicator 16 may be shaped like a small lever or button, just above the breech on top of slide 14, which pops up (by means of mechanical action) when a round is in the chamber. The striker status indicator 18 is located on the rear face of slide 14 and pops out when handgun 10 is cocked. The striker status indicator 18 is flush with the rear face of slide 14 when handgun 10 is not cocked.

Figure 3A:
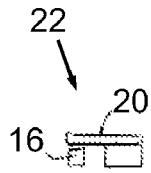
FIGS. 3A and 3B are simplified illustrations of the operation of the shot counter of FIG. 1, in accordance with an embodiment of the present invention.
Figure 3B:
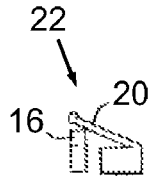

Reference is additionally made to FIGS. 3A and 3B, which illustrate the operation of a shot counter 20, in accordance with an embodiment of the present invention. In one non-limiting embodiment of the invention, shot counter 20 includes a switch 22 in proximity to loaded chamber indicator 16 or striker status indicator 18. In another embodiment, shot counter 20 includes a switch 22 in proximity to loaded chamber indicator 16 and another switch 22 in proximity to striker status indicator 18. When loaded chamber indicator 16 or striker status indicator 18 moves, it pushes against and activates switch 22. Switch 22 may be a microswitch which is thrown by the mechanical action of the indicator pushing against it. Alternatively, switch 22 may include an electrical contact which makes electrical contact with the indicator that pushes against it. When switch 22 is activated, it closes a circuit with a microprocessor 24 (mounted internally or externally on any portion of handgun 10 and in electrical communication with switch 22, or separate from the handgun) and/or a display 26 (disposed on any surface of handgun 10 or a display separate from the handgun). The microprocessor 24 interprets the electrical signal/current as an indication that a shot has been fired and this indication may be stored, or sent to a remote site, or displayed in display 26. The microprocessor 24 may also cause display (or recording in a memory) of the time/date each round was shot.

It is noted that in the case of using the loaded chamber indicator 16, the shot counter 20 actually counts the number of cartridges going in and out of the chamber, which is not necessarily the true number of bullets that exit the muzzle. Likewise, in the case of using the striker status indicator 18, the shot counter 20 actually counts the number of times the striker moved or the handgun 10 was cocked, not necessarily the true number of bullets that exit the muzzle. Nevertheless, for many purposes, a less than 100% accurate and foolproof shot counter is definitely adequate.

Alternatively, the switch could be placed to senses movement of the firing pin (by electrical or mechanical contact).

Figure 4:
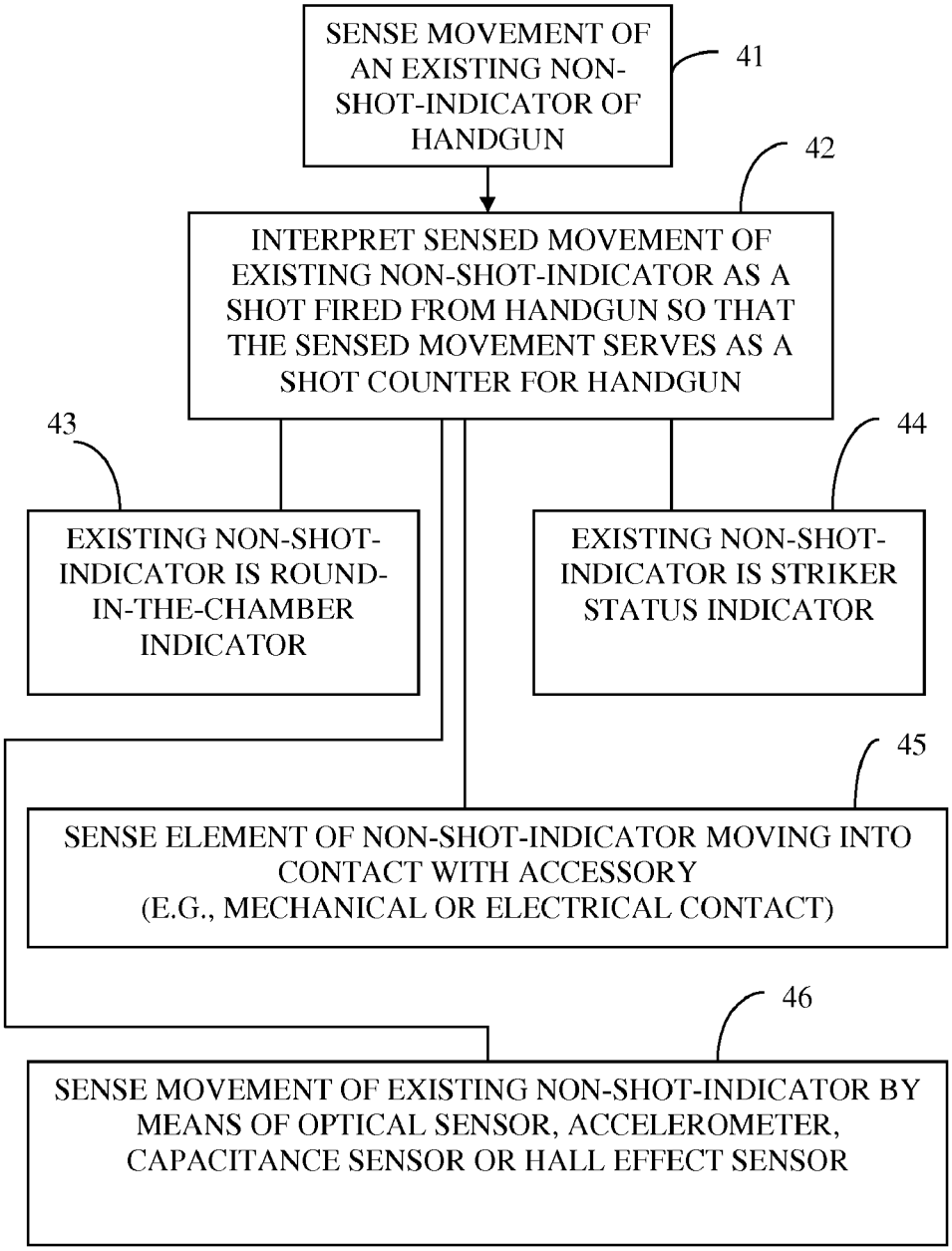
FIG. 4 is a simplified flow chart of a method for turning an existing non-shot-counter indicator of a handgun into a shot counter, in accordance with an embodiment of the present invention.

FIGS. 1-3B are just some examples of carrying out the invention. Reference is now made to FIG. 4, which is a simplified flow chart of a more generalized method for turning an existing non-shot-counter indicator of a handgun into a shot counter, in accordance with an embodiment of the present invention.

The method may include sensing movement of an existing non-shot-indicator of a handgun (41), and interpreting a sensed movement of the existing non-shot-indicator as a shot fired from the handgun so that the sensed movement serves as a shot counter for the handgun (42).

For example, the existing non-shot-indicator of the handgun may include a round-in-the-chamber indicator, wherein the sensed movement of the round-in-the-chamber indicator is interpreted as a shot fired from the handgun (43). As another example, the existing non-shot-indicator of the handgun may include a striker status indicator, wherein the sensed movement of the striker status indicator is interpreted as a shot fired from the handgun (44). An accessory may be positioned to come into contact with an element of the non-shot-indicator, wherein sensing movement of the existing non-shot-indicator may include sensing the element of the non-shot-indicator moving into contact with the accessory (45). The element of the non-shot-indicator may move into mechanical contact with the accessory and cause a portion of the accessory to move and indicate a shot has been fired. The element of the non-shot-indicator may move into electrical contact with the accessory and close a circuit, wherein closure of the circuit indicates a shot has been fired.

Alternatively, sensing movement of the existing non-shot-indicator may be by means of an optical sensor, accelerometer, capacitance sensor or Hall effect sensor (46). Upon compression of the recoil spring, the Hall effect sensor senses a change in magnetic field that is a function of proximity of the coils to one another.

Figure 5:
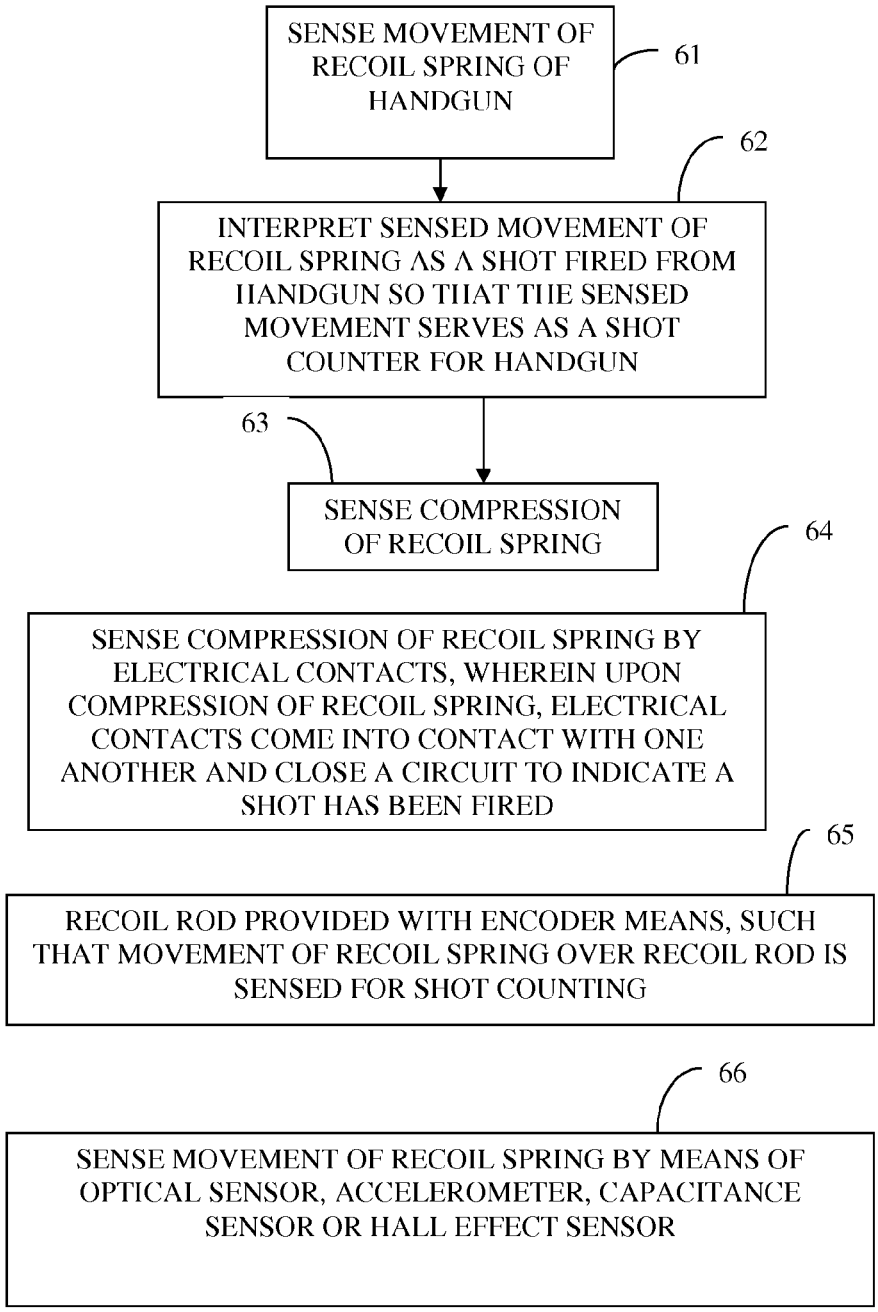
FIG. 5 is a simplified flow chart of a method for using a recoil spring of a handgun as a shot counter, in accordance with another embodiment of the present invention.

In accordance with another embodiment of the invention, the shot counter may exploit movement of a recoil spring of handgun 10. Reference is now made to FIG. 5 is a simplified flow chart of a method for using the recoil spring as a shot counter, in accordance with another embodiment of the present invention.

The method may include sensing movement of a recoil spring of a handgun (61), and interpreting a sensed movement of the recoil spring as a shot fired from the handgun so that the sensed movement serves as a shot counter for the handgun (62).

For example, sensing movement of the recoil spring may include sensing compression of the recoil spring, wherein compression of the recoil spring indicates a shot has been fired (63). The compression of the recoil spring may be sensed by electrical contacts, wherein upon compression of the recoil spring, the electrical contacts come into contact with one another and close a circuit, wherein closure of the circuit indicates a shot has been fired (64). Alternatively, a recoil rod may pass through the coils of the recoil spring. The recoil rod may be provided with encoder means, such that movement of the coils of the recoil spring over the recoil rod are sensed for shot counting (65). As another alternative, compression of the recoil spring may be sensed by an optical sensor, accelerometer, capacitance sensor or Hall effect sensor (66).

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A shot counter comprising:

a firearm comprising a loaded chamber indicator and a striker status indicator, wherein when said loaded chamber indicator protrudes out said firearm is loaded and when said loaded chamber indicator does not protrude out said firearm is not loaded, and when said striker status indicator protrudes out said firearm is cocked and when said striker status indicator does not protrude out said firearm is not cocked;

a first switch that operates with said loaded chamber indicator and a second switch that operates with said striker status indicator, wherein when said loaded chamber indicator moves it activates said first switch and when said striker status indicator moves it activates said second switch; and a processor in communication with said first and second switches, wherein if one of said first and second switches are activated, an electrical signal is sent to said processor and said processor interprets the electrical signal as an indication that a shot has been fired, wherein if the electrical signal is from the first switch being activated from movement of the loaded chamber indicator, the processor actually counts a number of cartridges going in and out of a chamber of the firearm, and if the electrical signal is from the second switch being activated from movement of the striker status indicator, the processor actually counts a number of times the firearm was cocked.

2. The shot counter according to claim 1, wherein said processor displays information on a display.

3. The shot counter according to claim 1, wherein said processor stores information in a memory.

4. The shot counter according to claim 1, wherein said first and second switches each comprise a microswitch which is thrown by a mechanical action of the indicator pushing against it.

5. The shot counter according to claim 1, wherein said first and second switches each comprise an electrical contact which makes electrical contact with the indicator that pushes against it.

* * * * *